United States Patent [19]

Putnam, Jr. et al.

[11] 4,118,913

[45] Oct. 10, 1978

[54] SHORT PRODUCT DROP VERTICAL FORM, FILL AND SEAL PACKAGING MACHINE

[75] Inventors: Roger L. Putnam, Jr., East Longmeadow; Edward F. O'Brien, Northampton, both of Mass.

[73] Assignee: Package Machinery Company, East Longmeadow, Mass.

[21] Appl. No.: 785,123

[22] Filed: Apr. 6, 1977

[51] Int. Cl.[2] ..... B65B 9/10

[52] U.S. Cl. ..... 53/551

[58] Field of Search ..... 53/29, 180 M, 182 M; 93/82; 226/95, 152

[56] References Cited

U.S. PATENT DOCUMENTS

| | | | |
|---|---|---|---|
| 2,608,405 | 8/1952 | Salfisberg | 226/95 |
| 3,318,067 | 5/1967 | Grafingholt | 53/180 M |

FOREIGN PATENT DOCUMENTS

| | | | |
|---|---|---|---|
| 827,792 | 2/1960 | United Kingdom | 53/180 M |

*Primary Examiner*—Robert Louis Spruill
*Attorney, Agent, or Firm*—McCormick, Paulding & Huber

[57] ABSTRACT

A package making machine of the vertical form, fill and seal type has a tube former for receiving flexible packaging material in thin flat strip form and for juxtaposing opposite side edges thereof in parallel vertically extending relationship to provide a depending tube open at the top. Side and end sealers respectively seal the vertical edge portions and provide vertically spaced horizontally extending end seals across the tube. A product dispenser associated with the former discharges measured quantities of product to the tube interior space through its open upper end, a bottom seal having first been provided across the tube by the end sealer. An improved tube advancing or feed means occupies a minimum space vertically beneath the former and provides for a short product drop. The feed means comprises a pair of vacuum feed rolls on spaced horizontal axes and in parallel relationship to peripherally engage opposite sides of the tube. Back-up members inside the tube provide for firm tube and roll engagement over a substantial portion of the roll peripheral surface and for efficient tube feeding operation. Alternatively, four vacuum feed rolls are provided in a rectangular configuration for four sided tube engagement. The vacuum rolls may have associated stationary distributors for sequentially providing a vacuum and venting the vacuum passageways and openings therein. Alternatively, vacuum boxes may be provided for hollow feed rolls with the rolls projecting partially through sealed openings to engage the tube.

24 Claims, 18 Drawing Figures

FIG. 14
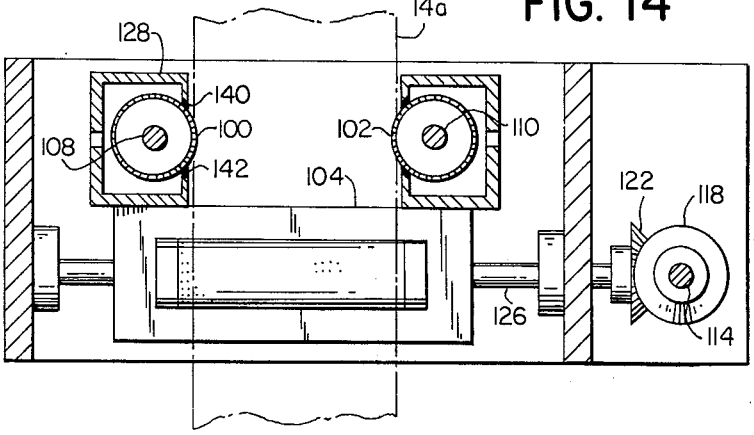
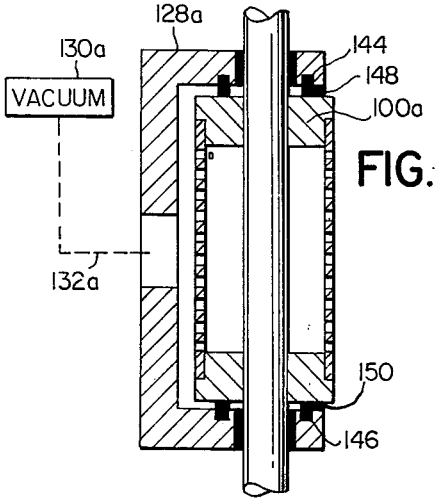
FIG. 15
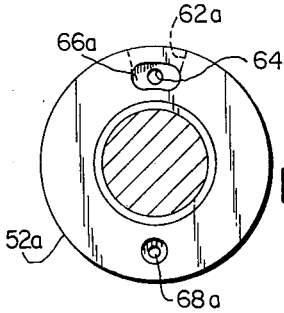
FIG. 17
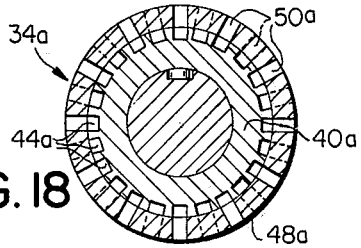
FIG. 18
FIG. 16
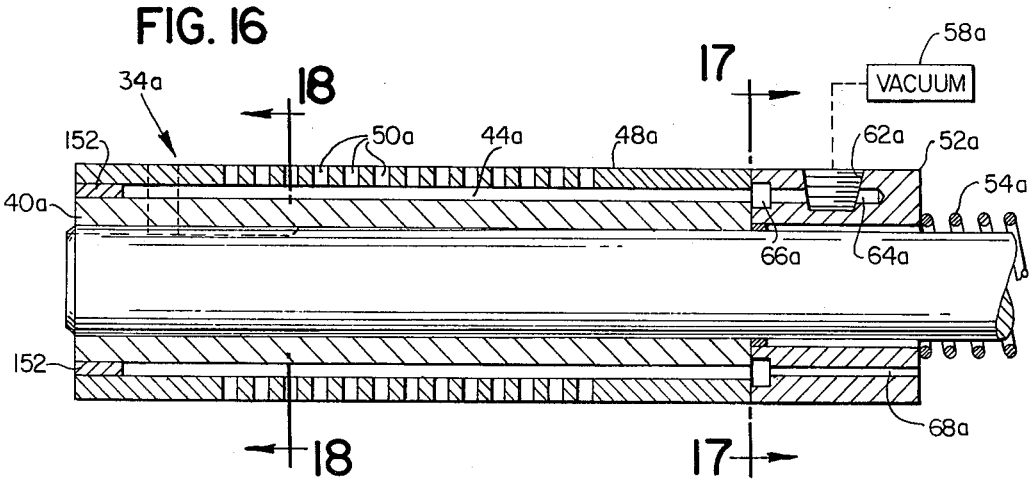

SHORT PRODUCT DROP VERTICAL FORM, FILL AND SEAL PACKAGING MACHINE

BACKGROUND OF THE INVENTION

This invention relates to machines for forming, filling and sealing packages from a thin flat strip of flexible packaging material, the strip of packaging material being formed to a depending upwardly open tubular configuration, sealed longitudinally at overlapped vertical edge portions, sealed transversely along horizontal lines spaced vertically of the tube, and filled from above with measured quantities of product between successive transverse sealing operations. In advancing or drawing the material downwardly through a tube former at the top of the machine, it has been a conventional practice to employ end sealing bars movable in both horizontal and vertical planes. That is, the end sealing bars are intermittently moved horizontally inwardly to engage and compress the tube and are then moved vertically downwardly to feed or draw the packaging material through the former. End sealing occurs during this operation. Thereafter, the end sealing bars move horizontally outwardly to release the tube and return vertically to their starting position.

A further conventional practice in advancing or feeding the packaging material through the former involves the use of a vacuum belt mechanism. A pair of perforate endless belts are disposed respectively on opposite sides of the tube to engage and feed the same downwardly through a reduced pressure or vacuum condition at the openings in the belt. End sealing bars in this arrangement may be stationary vertically but movable horizontally to intermittently engage and transversely seal the tube between feed and product drop or fill operations.

In both of the foregoing arrangements, a relatively long "product drop" is encountered. That is, the distance the product must fall from the discharge end of the hopper within the former is substantial. With the vertically movable end sealer arrangement the necessary vertical travel of the end sealers results in a substantial vertical distance through which the product must fall in the filling operation. Additionally, it should be noted that the portion of the tube immediately above the end sealer is in tension and is drawn into a relatively sharp or tight "V" configuration during the downward movement of the end sealers. This configuration is not conducive to a good filling operation nor is the resulting stress at the end seal conducive to good end sealing.

In the vacuum belt arrangement, belt and end sealer movement can be coordinated to provide for a relaxed condition of the tube above the end sealer, a relatively shallow or loose "V" configuration with a slight bulge or ballooning effect, and this is conducive to a good filling operation. End sealing may also efficiently accomplished in the absence of stress during sealing. The inner or operative runs of the vacuum belts, however, extend through a substantial vertical distance and a relatively long product drop distance is again encountered.

A long product drop is generally acceptable for relatively heavy material allowed to fall freely from the hopper into the tube in measured quantities. This is not the case, however, with relatively light product material such as potato chips. A condition known as product "string-out" is encountered with light materials wherein air resistance causes the upper portion of the mass of descending product to decelerate relative to the lower portion thereof. That is, a number of potato chips at the top of a mass of chips may tend to "string-out" vertically above the major portion of the mass as the product falls into the tube. Obviously, the time required for each filling operation is significantly increased by "string-out". This results in a severe limitation on the overall speed of operation of the machine and production rates are detrimentally affected.

SUMMARY OF THE INVENTION

It is a general object of the present invention to provide a vertical form, fill and seal machine which has the shortest possible "product drop" distance and which is therefore particularly well-suited for use in the packaging of relatively light products such as potato chips.

A further object of the invention resides in the provision of a tube feed means which occupies a minimum vertical space in the machine, which provides for rapid and efficient feeding of the tube, and which also provides for a relaxed condition of the tube above the end sealer for efficient filling and end sealing.

In fulfillment of these objects, at least two vacuum feed rolls are disposed beneath the tube former on spaced horizontal axes and in parallel relationship for peripheral engagement with opposite sides of the tube. The rolls have associated vacuum generating means in communication with small openings therein so as to grip the tube at their peripheral surfaces and a drive means rotates the rolls in opposite directions and at equal peripheral speeds whereby to draw the tube through the former for filling, sealing and package formation.

Preferably, back-up members are associated with the rolls and disposed within the tube to provide for firm engagement of the tube with the peripheral surface of the rolls through an optimum included angle of engagement and, it may also be desirable to provide vent means for positive release of the tube as the tube departs from the area of engagement with the roll surface. Venting may also be desirable on the approach side of the rolls.

BRIEF DESCRIPTION OF THE DRAWINGS

FIG. 14 is a vertical sectional view of the vacuum feed roll arrangement of FIGS. 11 through 13 taken generally as indicated at 14—14 in FIG. 13.

FIG. 15 is a horizontal section through a further alternative construction of a vacuum feed roll and associated housing and sealing means.

FIG. 16 is a vertical sectional view through a vacuum feed roll and distributor in a further alternative construction.

FIG. 17 is a vertical section through the feed roll and distributor of FIG. 16 taken generally as indicated at 17—17 in FIG. 16.

FIG. 18 is a vertical section through the feed roll of FIG. 16 taken generally as indicated at 18—18 in FIG. 16.

DESCRIPTION OF THE PREFERRED EMBODIMENTS

Figure 1:
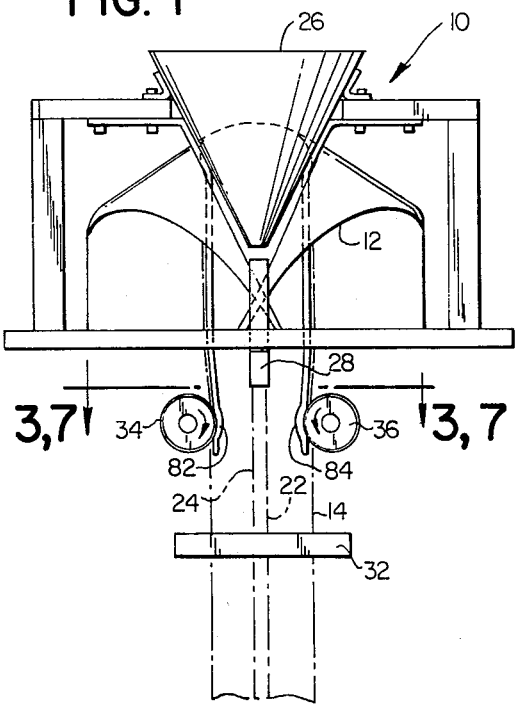
FIG. 1 is a schematic front view of a form, fill and seal machine forming a first embodiment of the present invention.
Figure 2:
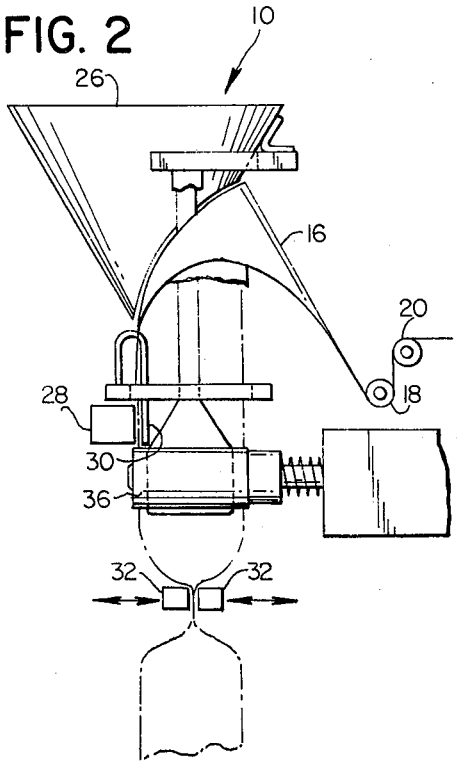
FIG. 2 is a schematic side view of the machine of FIG. 1.

Referring particularly to FIGS. 1 and 2, it will be observed that a form, fill and seal packaging machine indicated generally by the reference numeral 10 includes a tube former 12. The tube former 12 may be conventional and is adapted to form a cylindrical or round tube 14 from packaging material in the form of an elongated thin flat strip comprising successive package blanks as integral contiguous sections. A strip of such material is indicated at 16, best illustrated in FIG. 2, and is directed in its movement toward the former 12 by guide rolls 18, 20 from a source of supply. A source of supply, not shown, may take the form of a pay-off device including a storage roll from which the strip material is drawn. In passage through the former 12 the strip of material is progressively formed to the depending and upwardly open tube 14 with opposite longitudinal or vertical edge portions 22, 24 being juxtaposed by the former in overlapping and parallel vertically extending relationship. Thus, the strip of material 16 becomes a round tube 14 in passage through the former, but its edge portions 22, 24 remain initially in an unsealed condition.

While the tube former 12 is of the "round" type with the tube 14 having a generally cylindrical cross sectional configuration, it should be noted that the term "tube" is used in its broad sense and is not to be construed as limited to a cylindrical tube or to any other tube of particular cross sectional configuration. Similarly, terminology denoting geometrical or spacial relationship such as "vertical", "horizontal", "depending", "beneath", etc. is employed merely for ease and convenience in description and is not to be regarded as limiting in any sense in the description or the claims which follow.

A product dispensing means associated with the tube former 12 is indicated generally by the reference numeral 26 and may comprise a funnel like element or hopper and a cooperating gate means (not shown). The gate means operates intermittently for the gravity discharge of measured quantities of product to the tube interior space through its upwardly open end. As will be apparent, it is necessary to provide side and end seals to form an upwardly open tubular package for reception of the measured quantity or charge of product from the dispenser 26.

Side sealing means may vary within the scope of the invention and an intermittently operable side sealing means may be provided as disclosed in U.S. Patent application Ser. No. 718,072 now Pat. No. 4,043,098 entitled VERTICAL FORM, FILL AND SEAL PACKAGING MACHINE WITH IMPROVED BACK-UP BAR FOR LONGITUDINAL SEALING. In the arrangement shown and described in this application, a vertically extending longitudinal or side sealing bar cooperates with a back-up element to intermittently seal vertical sections of the overlapped edges of a tube such as the edges 22, 24. The tube is held stationary during sealing and the arrangement may be generally satisfactory for short product drop operation with relatively short bags. When longer bags are required, however, the required length of the sealing bar results in a relatively long product drop and this arrangement may be unsatisfactory.

It is the presently preferred practice, particularly when longer bags are required, to provide a continuous or "in-transit" side sealing means which occupies a minimum vertical space and which permits short product drop operation. That is, it may not be necessary to form the full length of the bag before end sealing occurs and the product filling operation may continue after end sealing and during further feeding of the tube prior to the next succeeding end sealing operation. Such operation is not possible with the intermittently operable vertically fixed sealing bar discussed above.

One form of continuous or "in-transit" side sealer is illustrated in FIGS. 1 and 2 and comprises a drag sealing block 28 positioned beneath the former 12 and externally engageable with the vertical edges 22, 24 of the tube. A back-up member 30 positioned within the tube and in interior engagement with the edges 22, 24 cooperates with the drag sealing block 28 to continuously seal the edges in passage therebetween. The drag sealer shown is of a conventional type and occupies a minimum vertical space in conformity with the short product drop concept. Obviously other types of continuous side sealers may be employed.

End sealing means may also vary within the scope of the invention. Apparatus illustrated schematically in FIGS. 1 and 2 comprises a pair of sealing bars 32, 32 disposed beneath and closely adjacent the tube feed means to be described hereinbelow. The sealing bars 32, 32 are fixed vertically but movable horizontally toward and away from the tube 14 whereby intermittently to seal the tube transversely in vertically spaced locations therealong. As will be apparent, an end seal may be provided whereby initially to form partial packages with the bottoms sealed and with the tops open for product reception and thereafter to close the tops and to form filled or product bearing packages. It should be noted that product fall may commence during or even slightly before end seal formation and may continue after the end seal has been completed, the bars 32, 32 withdrawn and a subsequent feeding movement of the tube commenced. It should also be noted that the vertical positioning of the end sealers 32, 32 is such that a minimum vertical distance is provided between the bottom seal of a partially formed bag and the hopper 26. Thus, short product drop operation is provided for. Conventionally, end sealers such as 32, 32 operate to provide a transverse or end seal at the top of one package and simultaneously provide a bottom end seal on the next succeeding package. A cut-off operation is also conventional during end sealing to sever a completed and filled package beneath the end sealer.

The details of end sealer construction and operation are well known and involve merely the intermittent horizontal inward and outward movement of the sealing bars 32, 32. Operation of the bars is of course conducted in appropriately timed relationship with that of the feed means, the product dispenser, etc. Heat sensitive sealing, pressure sensitive sealing and other forms of sealing may be employed.

It is also within the scope of the present invention to provide for a "flying" end seal. That is, the intermittent tube feeding operation conventionally employed may be replaced by a continuous tube feeding operation and the end sealers may engage and seal the tube as it continues to move, or on the "fly". The older type of tube feeding end sealers mentioned above may be employed for this purpose with suitable modification in timing. That is, the end sealers may be timed to engage a tube and then move vertically downwardly therewith and at the same speed, rapidly returning upwardly to again engage and seal the tube above a quantity of product deposited therein and prior to discharge of the next succeeding quantity of product. Obviously, other types of "flying" end sealers may also be employed. With a "flying" end sealer and a continuous side sealer such as the sealer 28, it will be apparent that operation of the machine may be continuous rather than intermittent. Intermittent discharge of quantity of products will occur but the tube may be continuously fed downwardly and an overall improvement in the speed of machine operation achieved.

The improved tube feed means of the present invention is readily adaptable to both intermittent and continuous tube feeding operation and in either event a minimum vertical space is occupied to provide for a short product drop. As mentioned, at least two vacuum feed rolls are provided beneath the former and are arranged on spaced horizontal axes and in parallel relationship so as to peripherally engage opposite sides of the tube 14. Thus, feed rolls 34 and 36 in FIGS. 1 through 4 are arranged to have their peripheral surfaces in engagement with the tube 14 and are driven in opposite directions but at equal peripheral speeds to engage and grip the tube and to draw the same downwardly through the former 12. A plurality of small openings through the peripheral surfaces of the rolls are connected with a vacuum generating means at least during that period of time when the openings are in communication with the tube to provide for reduced pressure or vacuum gripping of the tube. Vent means may also be provided for efficient approach and release of the tube.

The number, size and arrangement of the vacuum openings may vary but a large number of relatively small circular openings in axially extending rows is presently preferred. It is believed that provision should be made for communication of at least two axially spaced openings and at least two peripherally spaced openings with the tube for efficient gripping and feeding operation. As shown, a considerably larger number of small openings on each roll communicate with the tube at all times.

Figure 5:
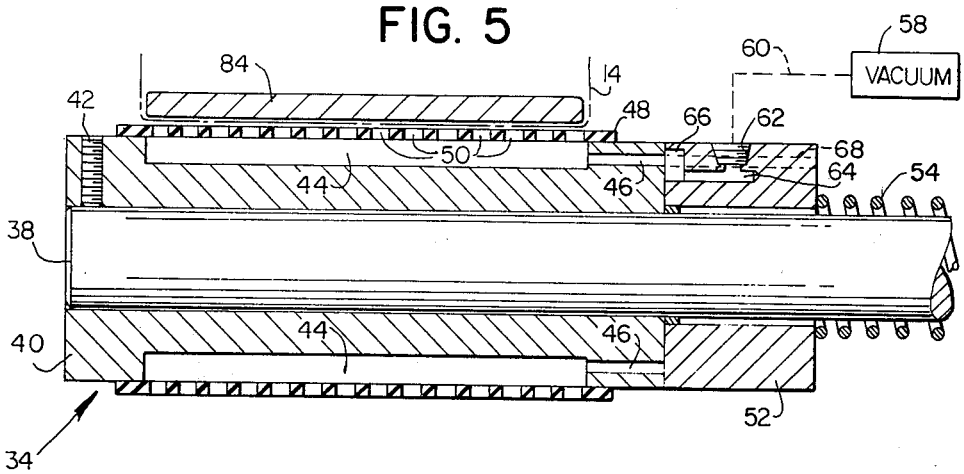
FIG. 5 is a further enlarged sectional view of a single vacuum feed roll taken generally as indicated at 5—5 in FIG. 4.
Figure 6:
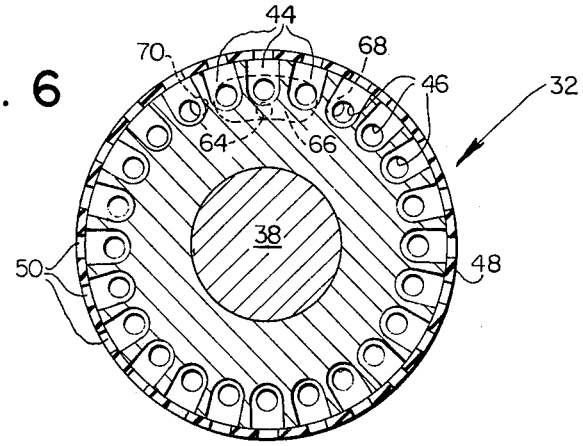
FIG. 6 is a further enlarged radial sectional view taken through a feed roll as indicated generally at 6—6 in FIG. 4.

Referring particularly to FIGS. 5 and 6, it will be seen that the feed roll 34, which may be identical with a feed roll 36, is mounted on a drive shaft 38 and has a cylindrical body portion 40 which may be keyed to the shaft at 42. The body portion 40 of the feed roll is provided with a series of axially extending grooves 44, 44 along its peripheral surface and which terminate short of the ends of the surface and open radially outwardly. Twenty four grooves 44, 44 are shown and each groove has an associated axial passageway 46 which communicates therewith at its inner end and extends to the outer or right hand radial surface of the body portion 40. The right hand ends of the passageways 46, 46 are thus open axially and, as best illustrated in FIG. 6, the grooves 44, 44 and passageways 46, 46 are arranged in equal circumaxially spaced relationship. Obviously, reduced pressure or vacuum conditions can be provided selectively in the grooves 44, 44 through communication with the associated passageways 46, 46 at their right hand end portions.

A hollow cylindrical member or sleeve 48 is disposed tightly about the body portion 40 of the roll 34 and defines the vacuum openings. The sleeve 48 is secured to the body portion 40 for rotation therewith and may be constructed of various materials. It is preferred, however, that a rubber-like material be used for frictional assistance in feeding the tube.

Vacuum openings 50, 50 in the sleeve 48 are arranged in peripherally spaced axially extending rows and 24 such rows are shown for communication respectively with the 24 grooves 44, 44. Each row of openings contains fourteen openings and each opening is circular in configuration and between one-eighth and one-fourth inches in diameter. Spacing between openings should be no less than one-half inch and is considerably less in the embodiment shown. All openings 50, 50 communicate with their respective grooves 44, 44 which in turn communicate with the axial passageways 46, 46 for the establishment of a vacuum or reduced pressure condition at the openings.

A distributor 52 selectively establishes communication between the axial passageways 46, 46 and a vacuum generating means and, in the presently preferred form, a vent means is also connectible with the passageways. The distributor 52 takes the form of a cylindrical member loosely mounted on the shaft 38 so as to be unaffected by shaft rotation. Lapped surfaces at the left hand end of the distributor and at the right hand end of the roll body portion 40 are tightly engaged to provide for substantially air tight relative rotation therebetween. A biasing means in the form of a coil spring 54 disposed about the drive shaft 38 and seated at a rigid surface such as bearing block 56, FIG. 4, urges the distributor 52 leftwardly in FIG. 5. Thus, the distributor is permitted to freely locate itself for tight engagement of the aforementioned lapped surfaces at its left hand end.

A vacuum generating means which may be conventional and which is illustrated schematically at 58, FIG. 5, is connected by line 60 with a radial port 62 in the distributor 52 and in turn with a short axial passageway 64. The passageway 64 extends to a small distributor or manifold chamber 66 which opens axially leftwardly so as to communicate with the open ends of the passageways 46, 46. The manifold chamber 66 takes a generally oval configuration viewed axially, FIG. 6, and is adapted to communicate with the passageways 46, 46 sequentially as the open ends thereof rotate past the chamber. With the arrangement of the openings 50, 50 as described, it is preferred that the chamber 66 communicate with at least two passageways 46, 46 simultaneously and as illustrated, three passageways 46, 46 communicate with the chamber simultaneously, FIG. 6. This of course provides for three adjacent rows of openings 50, 50 which are fully or at least partially subjected to vacuum or reduced pressure at all times.

In accordance with the presently preferred practice, a vent means is also provided for the vacuum openings 50, 50. As best illustrated in FIG. 6, a first vent conduit 68 is provided in the distributor 52 and extends axially from left to right hand ends thereof, FIG. 5. At its right hand end the passageway is open to atmosphere and at its left hand end it communicates sequentially with the passageways 46, 46 during rotation of the roll 34. Assuming clockwise rotation of the roll in FIG. 6 and communication of the three rows of openings 50, 50 which are connected with the manifold 66 with the tube 14, it will be seen that the passageway 68 is positioned downstream of the manifold or, in a zone where the tube departs from the peripheral surface of the roll. With the passageway 68 so positioned, the leading row of openings 50, 50 passes from communication with the manifold 66 first to a dead area between the manifold and the passageway 68 and then communicates with the said passageway. When this occurs, air at atmospheric pressure is permitted to pass leftwardly through the passageway 68, through the associated passageway 46, the associated groove 44 and through the openings 50, 50 in said leading row. The tube is thus positively released from the peripheral surface of the feed roll 34 and an effective tube feeding operation results.

A second vent passageway 70 located to the left of the manifold 66 in FIG. 6 serves a similar purpose as the tube approaches the peripheral surface of the roll 34. That is, a row of openings in communication with the passageway 70 is maintained at or near atmospheric pressure immediately prior to vacuum gripping of the tube by the preceding row of openings. Thus, premature gripping of the tube and inefficient tube feeding operation is avoided.

Figure 3:
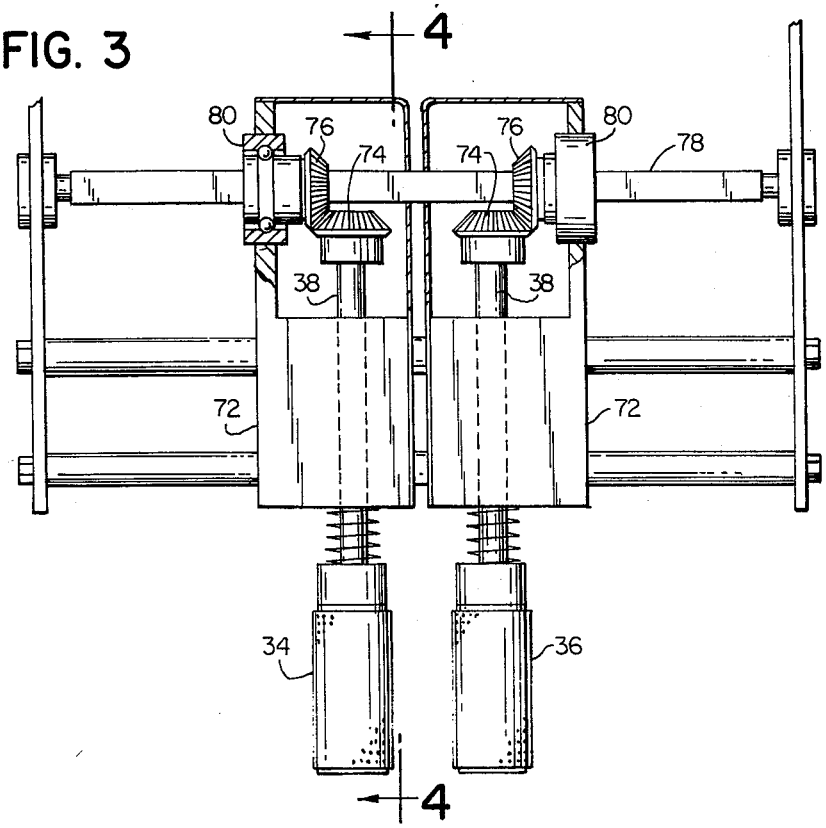
FIG. 3 is an enlarged somewhat schematic sectional view of the machine taken generally as indicated in 3—3 in FIG. 1 and illustrating a drive means for the vacuum feed rolls.
Figure 4:
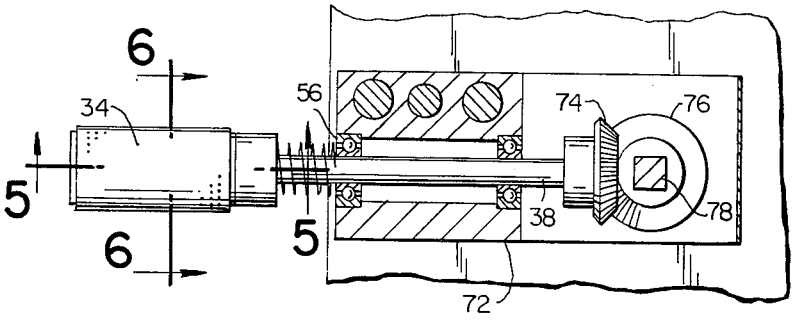
FIG. 4 is a somewhat schematic vertical sectional view of the feed rolls and drive means taken generally as indicated at 4—4 in FIG. 3.

In FIG. 3, a mechanism for driving the feed rolls 34, 36 is illustrated and it should be apparent that the said mechanism can be readily adapted for intermittent or continuous rotation of the rolls as mentioned. Drive shafts 38, 38 for the rolls 34, 36 extend through and are supported by similar bearing boxes 72, 72 and bevel gears 74, 74 at rear end portions thereof respectively mesh with and are driven by bevel gears 76, 76. The gears 76, 76 are mounted on a main drive shaft 78, journalled at 80, 80 and which may be rotated by an electric motor or other appropriate drive means. Such drive means is of course operated in timed relationship with other operating elements in the machine.

Figure 8:
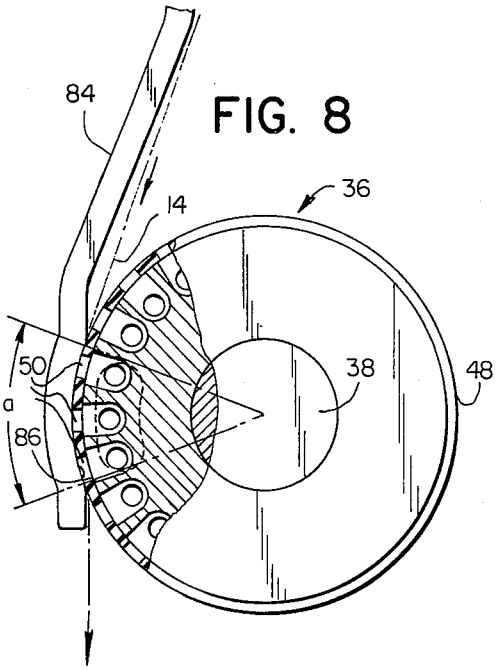
FIG. 8 is an enlarged vertical fragmentary sectional view taken generally as indicated at 8—8 in FIG. 7 and illustrating a single vacuum feed roll and back-up member.

Preferably the feed rolls 34, 36 have associated back-up members disposed within the tube 14 and urging the tube into engagement with the peripheral surfaces of the rolls. Engagement between the tube and the roll surfaces should be maintained through an included angle of at least 15° measured from the roll axis and in the preferred embodiment illustrated, provision is made for tube and roll surface engagement through an included angle in excess of 30°. The included andle "*a*" of tube and roll engagement illustrated in FIG. 8 is approximately 40° and it will be seen that three rows of vacuum openings 50, 50 communicate with the tube at all times. Excellent tube feeding operation has been achieved with this arrangement, the three communicating rows of openings being maintained under vacuum or reduced pressure in the manner explained above.

Figure 7:
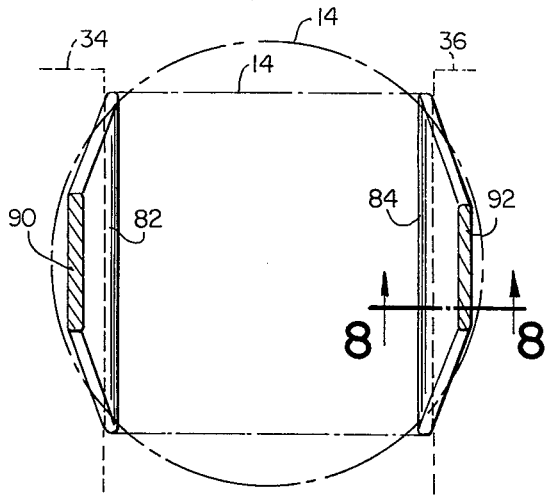
FIG. 7 is an enlarged horizontal sectional view taken generally as indicated at 7—7 in FIG. 1 and illustrating the cooperative relationship of the vacuum feed rolls and their associated back-up members.
Figure 9:
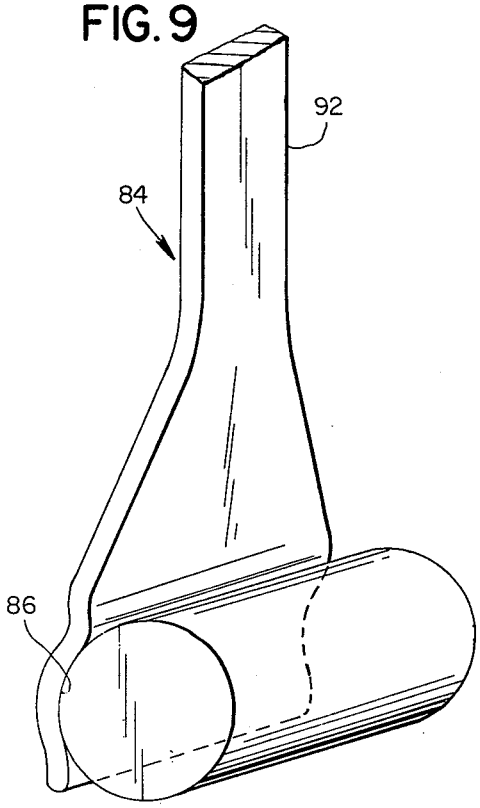
FIG. 9 is a perspective view illustrating a single feed roll and back-up member.

Feed roll back-up members 82, 84, shown in FIGS. 1 and 7, are identical in construction but in reverse arrangement for cooperation respectively with the rolls 34, 36. In FIGS. 8 and 9 it will be observed that back-up member 80 has an arcuate surface 86 which is of rigid construction and which faces toward and conforms to the peripheral surface of the roll 36. The arcuate surface 86 extends through an arc of at least 30° and, as shown, through the arc "*a*" of approximately 40°.

Reverting to FIG. 7, it will be observed that each of the back-up members 82, 84 has an axial dimension or width approximately equal to one side of a square having substantially the same peripheral dimension as the round tube 14. Upper portions 90, 92 of the back-up members 82, 84 are substantially narrower than lower arcuate portions thereof and are bent slightly so as to incline radially outwardly with respect to the center line of the tube, FIG. 9. Thus, the tube 14 leaves the former 12 in a cylindrical or round configuration as mentioned above but is converted to a square cross sectional configuration by the back-up members 82, 84, FIG. 7. As will be apparent, the area of tube and feed roll engagement is thus substantially increased in the axial direction and, as illustrated in FIG. 5, all 14 openings 50, 50 in each row of openings are thus brought into communication with the tube. This feature of the invention further enhances the efficiency of the feeding operation.

Figure 10:
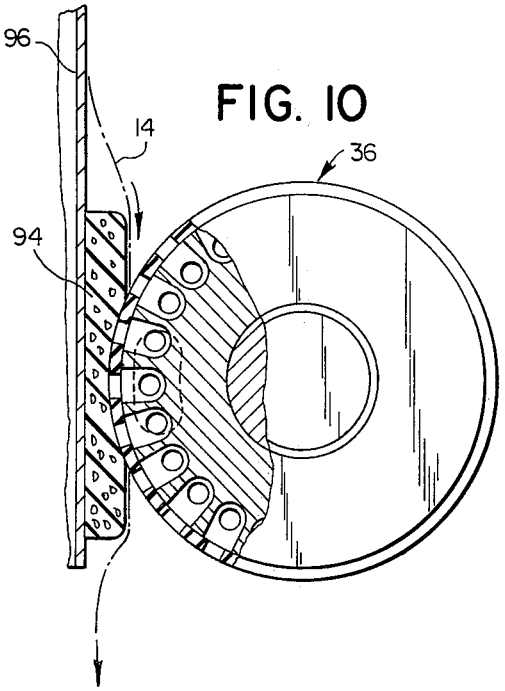
FIG. 10 is a vertical sectional view similar to FIG. 8 but showing an alternative form of a back-up member in a "tube-type" form, fill and seal packaging machine.

In FIG. 10 a second type of back-up member is illustrated in the form of a compressible element 94. The element 94 functions in a manner similar to the back-up members 82, 84 and is preferably provided with a low friction surface for engagement with the tube 14. The element 94 is, however, particularly well suited to a "tube type" form, fill and seal machine. In such a machine a cylindrical support tube depends from a former such as 12 within the tube of packaging material. A portion of such tube is illustrated at 96 and the back-up member 94 is shown mounted externally thereon. The tube 14 travelling down and about the support tube 96 is urged radially outwardly by the back-up member 94 into firm engagement with the peripheral surface of the roll 36 as required for effective vacuum gripping and feeding.

Figure 11:
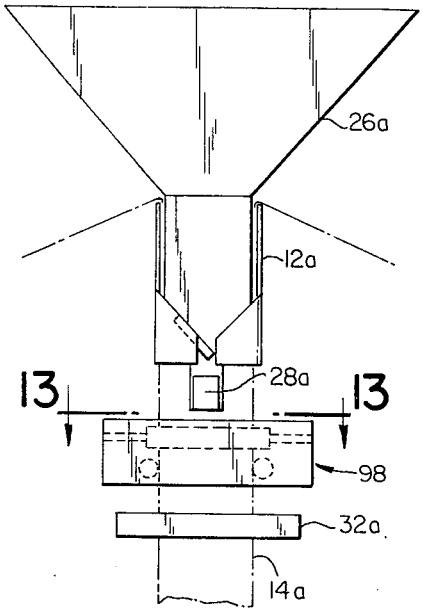
FIG. 11 is a schematic front elevational view of a form, fill and packaging machine forming a second embodiment of the present invention.
Figure 12:
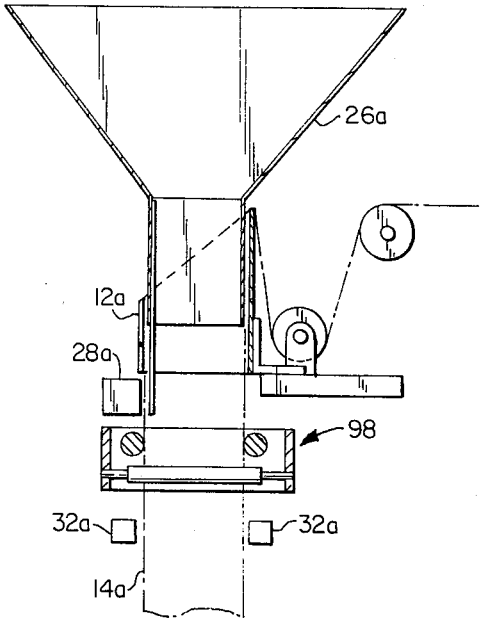
FIG. 12 is a schematic side elevational view of the machine in FIG. 11.

In a further embodiment of the invention illustrated in FIGS. 11 and 12 a former 12*a* is of the square rather than the round type and has an associated hopper 26*a*, a drag sealer 28*a*, end sealers 32*a*, 32*a* and a vacuum roll feed means 98. The feed means 98 comprises four feed rolls arranged in two opposing pairs in a substantially square configuration and provides for an enlarged area of tube to roll engagement but is of course somewhat more complex in construction. The feed means may be employed with either a square or round tube former.

Figure 13:
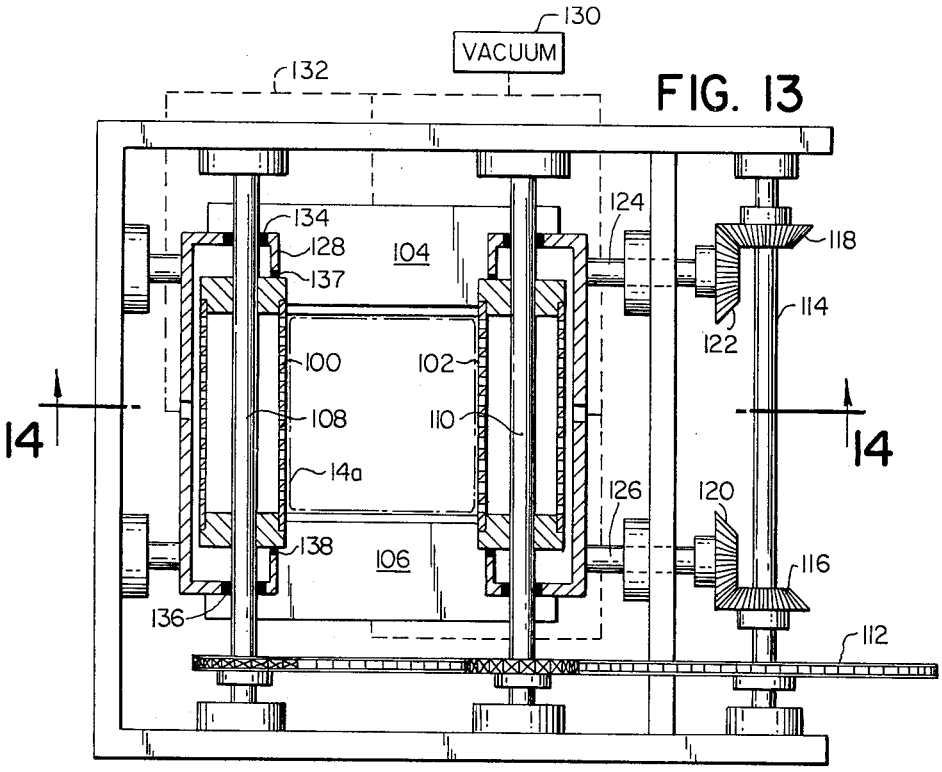
FIG. 13 is an enlarged somewhat schematic horizontal sectional view taken generally as indicated at 13—13 in FIG. 11 and illustrating drive means for vacuum feed rolls in an alternative construction thereof.

A first pair of feed rolls 100, 102 arranged in opposing relationship, are shown disposed above a second pair of similar rolls 104, 106 in FIG. 13. Drive shafts 108, 110 for the rolls 100, 102 are rotated in unison and in opposite directions as by a chain drive 112 and suitable sprockets on the shafts. The chain 112 also rotates a shaft 114 carrying a pair of bevel gears 116, 118 respectively driving bevel gears 120, 122. Bevel gears 120, 122 are in turn mounted respectively on drive shafts 124, 126 for the feed rolls 104 and 106.

The construction of the feed rolls 100, 102 et sequa differ somewhat from that described above. Each feed roll has an associated housing or vacuum box such as the box 128 for the roll 100. The rolls are hollow so that the vacuum openings therein can communicate with the interior of the box for reduction of pressure at the vacuum openings. The vacuum box 128 communicates with a vacuum generating means shown schematically at 130 through a line indicated at 132. Other appropriate lines may of course extend to the other vacuum boxes as shown so as to be connected in common with the vacuum generating means 130.

The vacuum boxes are maintained in fixed position and the drive shafts extend therethrough with the feed rolls mounted thereon. Thus, annular seals 134, 136 are provided about the shaft 108 in the box 128. A rectangular opening at the front of the box 128 allows a portion of the peripheral surface of the roll 100 to project therethrough into engagement with a tube 14*a*. Obviously, the arcuate portion of the roll engaging the tube can be determined by the size of the rectangular opening. A sealing means extending about the opening engages the roll along its peripheral surface and its radial end surfaces. That is, horizontal upper and lower linear seals engage the peripheral surface of the roll and opposite vertically extending linear seals engage opposite radial end surfaces of the roll. Such sealing means are indicated generally at 137, 138 in FIG. 13 and 140, 142 in FIG. 14.

FIG. 15 illustrates a second form of vacuum box feed roll arrangement and a box 128*a* therein is generally similar to the box 128 but is provided with first and second annular seals 144, 146. The annular seals 144, 146 respectively engage opposite radial end surfaces of the feed roll 100*a* and cooperate with seals 148, 150 in providing a substantially air tight box. The seals 148 and 150 extend vertically at end surfaces of the feed roll and horizontal seals may also engage the feed roll at its peripheral surface in the manner of seals 140 and 142 in FIG. 14. A vacuum generating means 130*a* communicates with the interior of the box 128*a* via a line 132*a* and the roll 100*a* is of hollow construction for operation in a manner similar to the roll 100.

FIGS. 16 and 17 and 18 illustrate a further form of feed roll and distributor. As best seen in FIG. 16, a body portion 40*a* of a roll 34*a* has a plurality of axial grooves 44*a*, 44*a* which extend throughout the length of the roll. Small filler members 152, 152 are provided at a left hand end of the feed roll for closing the grooves 44*a*, 44*a* and a sleeve 48*a* is secured about the body portion as in the case of the sleeve 48 described above. The grooves 44*a*, 44*a* extend to a right hand radial end surface of the body portion which may be lapped for engagement with a similarly lapped radial end surface of a distributor 52*a*. The distributor 52*a* has an associated bias spring 54*a* and a manifold or distributor chamber 66*a*. The manifold chamber 66*a* communicates with a source of low pressure air at a vacuum generating means 58*a* through an axial passageway 64*a* and a port 62*a*.

Chamber 66*a*, as best illustrated in FIG. 17, is somewhat smaller than chamber 66 and may provide for communication with two grooves 44*a*, 44*a* whereby to communicate with two rows of openings 50*a*, 50*a* in the sleeve 48*a*. Thus, a lesser area of engagement between the roll peripheral surface and the tube is provided for than in the case of the roll 34. Further, a somewhat different venting means is provided. A vent passageway 68*a* in the distributor 52*a* is disposed at an opposite side of the distributor from the manifold 66*a* for a remote venting operation of the vacuum openings 50*a*, 50*a*.

The FIGS. 16–18 feed roll and distributor construction may be found suitable for certain applications involving tubes of specific types of film or other material. Further, the construction is somewhat more easily manufactured than the roll construction of FIGS. 5, 6, etc.

From the foregoing, it will be apparent that various feed roll constructions and arrangements are contemplated within the scope of the invention. In each instance, a minimum vertical space is occupied by the vacuum feed roll mechanism and the concept of short product drop is adhered to. Product "string out" is avoided and efficient high speed machine operation is achieved. Intermittent or continuous feed roll operation is readily accommodated and tube feeding versatility as well as efficiency is enhanced.

We claim:

1. In a vertical form, fill and seal packaging machine having a source of flexible packaging material in the form of an elongated thin flat strip comprising successive package blanks as integral contiguous sections thereof, a tube former adapted to receive said strip material and progressively form the same to a depending and upwardly open tubular configuration, opposite longitudinal edge portions of the material being progressively juxtaposed by said former in parallel vertically extending relationship, product dispensing means associated with said former and operable for the gravity discharge of measured quantities of product to the tube interior spaced through its upwardly open end, at least two feed rolls disposed beneath and closely adjacent the former and arranged on spaced horizontal axes and in parallel relationship so as to peripherally engage opposite sides of the tube, each of the rolls having a plurality of small peripheral openings along at least that portion of its length engageable with the tube, and said rolls arranged to engage the tube on opposite sides thereof, each at an area spaced approximately 90° around the tube from its said vertical edges, end sealing means disposed beneath and closely adjacent said feed rolls to provide longitudinally spaced horizontal end seals across the tube, vertically stationary side sealing means of the continuous sealing type between the feed rolls adjacent the tube edges to seal the same in movement therepast, said side sealing means terminating at its lower end above said end sealing means, vacuum generating means in communication with the roll openings to cause the rolls to grip the tube at their peripheral surface, and means for turning the rolls in opposite directions and at equal peripheral speeds whereby to draw the tube downwardly through the former and successively to present integral blanks in tubular form therebeneath for filling, sealing and package formation.

2. The improvements in a vertical form, fill and seal packaging machine as set forth in claim 1 wherein said openings in said rolls are so spaced that at least two axially spaced and at least two peripherally spaced openings in each roll are in communication with the tube external surface at all times.

3. The improvements in a vertical form, fill and seal packaging machine as set forth in claim 2 wherein said openings are arranged in peripherally spaced axially extending rows with openings of at least two rows of openings communicating with the tube external surface at all times.

4. The improvements in a vertical form, fill and seal packaging machine as set forth in claim 3 wherein openings of three rows of axial extending openings are in communication with the tube external surface at all times.

5. The improvements in a vertical form, fill and seal packaging machine as set forth in claim 1 wherein a pair of back-up members are provided within the tube respectively for said two rolls, each of said back-up members engaging the tube internally and urging the same into engagement with the peripheral surface of the associated roll through an included angle of at least fifteen degrees (15°) measured from the roll axis.

6. The improvements in a vertical form, fill and seal packaging machine as set forth in claim 5 wherein each of said back-up members is constructed and arranged to provide for roll and tube engagement through an included angle in excess of 30°.

7. The improvements in a vertical form, fill and seal packaging machine as set forth in claim 1 wherein four feed rolls are provided and arranged in two opposing pairs in a substantially square configuration viewed vertically.

8. The improvements in a vertical form, fill and seal packaging machine as set forth in claim 7 wherein said two pairs of feed rolls are staggered vertically, and wherein a common drive means is provided for rotating all of said rolls.

9. In a vertical form, fill and seal packaging machine having a source of flexible packaging material in the form of an elongated thin flat strip comprising successive package blanks as integral contiguous sections thereof, a tube former adapted to receive said strip material and progressively form the same to a depending and upwardly open tubular configuration, opposite longitudinal edge portions of the material being progressively juxtaposed by said former in parallel vertically extending relationship, product dispensing means associated with said former and operable for the gravity discharge of measured quantities of product to the tube interior spaced through its upwardly open end, side and end sealing means disposed beneath said former respectively to seal said longitudinal edge portions of the tube and to provide longitudinally spaced horizontal end seals across the tube, the improvement comprising at least two feed rolls disposed beneath the former and arranged on spaced horizontal axes and in parallel relationship so as to peripherally engage opposite sides of the tube, each of the rolls having a plurality of small peripheral openings along at least that portion of its length engageable with the tube, a pair of back-up members within the tube respectively for said two rolls, and each having a rigid arcuate surface facing toward and conforming to the peripheral surface of its associated roll, each of said back-up members engaging the tube internally and urging the same into engagement with the peripheral surface of the associated roll through an included angle of at least 15° measured from the roll axis, vacuum generating means in communication with the roll openings to cause the rolls to grip the tube at their peripheral surface, and means for turning the rolls in opposite directions and at equal peripheral speeds whereby to draw the tube downwardly through the former and successively to present integral blanks in tubular form therebeneath for filling, sealing and package formation.

10. The improvements in a vertical form, fill and seal packaging machine as set forth in claim 9 wherein said former is adapted to provide a cylindrical tube, and wherein each of said back-up members is of a width approximately equal to one side of a square having substantially the same peripheral dimension as the tube, said back-up members thus serving cooperatively to convert the tube to a substantially square cross-sectional configuration in the horizontal plane of the rolls.

11. The improvements in a vertical form, fill and seal packaging machine as set forth in claim 10 wherein each of said rolls is provided with a series of axially extending rows of openings which rows are spaced peripherally so that three rows of openings communicate with the tube external surface at all times.

12. The improvements in a vertical form, fill and seal packaging machine as set forth in claim 11 and including distributor and vent means associated with each of said rolls and operable to connect the openings of said rows of openings selectively with said vacuum generating means and vent means during rotation of the rolls, the three rows of openings communicating with the tube external surface being connected with said vacuum generating means and at least one row of openings preceding said three rows of openings during rotation being vented for release of the film.

13. In a vertical form, fill and seal packaging mahcine having a source of flexible packaging material in the form of an elongated thin flat strip comprising successive package blanks as integral contiguous sections thereof, a tube former adapted to receive said strip material and progressively form the same to a depending and upwardly open tubular configuration, opposite longitudinal edge portions of the material being progressively juxtaposed by said former in parallel vertically extending relationship, product dispensing means assoiciated with said former and operable for the gravity discharge of measured quantities of product to the tube interior spaced through its upwardly open and side and end sealing means disposed beneath said former respectively to seal said longitudinal edge portions of the tube and to provide longitudinally spaced horizontal end seals across the tube, the improvement comprising at least two feed rolls disposed beneath the former and arranged on spaced horizontal axes and in parallel relationship so as to peripherally engage opposite sides of the tube, each of the rolls having a plurality of small peripheral openings along at least that portion of its length engageable with the tube, a pair of back-up members within the tube respectively for said two rolls, and each having a soft compressible surface facing toward and comformable with the peripheral surface of its associated roll, each of said back-up members engaging the tube internally and urging the same into engagement with the peripheral surface of the associated roll through an included angle of at least 15° measured from the roll axis, vacuum generating means in communication with the roll openings to cause the rolls to grip the tube at their peripheral surface, and means for turning the rolls in opposite directions and at equal peripheral speeds whereby to draw the tube downwardly through the former and successively to present integral blanks in tubular form therebeneath for filling, sealing and package formation.

14. In a vertical form, fill and seal packaging machine having a source of flexible packaging material in the form of an elongated thin flat strip comprising successive package blanks as integral contiguous sections thereof, a tube former adapted to receive said strip material and progressively form the same to a depending and upwardly open tubular configuration, opposite longitudinal edge portions of the material being progressively juxtaposed by said former in parallel vertically extending relationship, product dispensing means associated with said former and operable for the gravity discharge of measured quantities of product to the tube interior spaced through its upwardly open end, side and end sealing means disposed beneath said former respectively to seal said longitudinal edges portions of the tube and to provide longitudinally spaced horizontal end seals across the tube, the improvement comprising at least two feed rolls disposed beneath the former and arranged on spaced horizontal axes and in parallel relationship so as to peripherally engage opposite sides of the tube, vacuum generating means in communication with the roll openings to cause the rolls to grip the tube at their peripheral surface, each of said rolls having a series of peripherally spaced axially extending rows of openings and an axial passageway extending to one end of the roll for each row of openings, a stationary distributor member adjacent said one end of each roll and operable to connect said axial passageways sequentially with said vacuum generating means during rotation of the rolls and as the rows of openings communicate with the tube, said distributor member having a manifold chamber connecting at least two axial passageways in common with the vacuum means as the rows of openings associated with said two passageways communicate with the tube external surface, and means for turning the rolls in opposite directions and at equal peripheral speeds whereby to draw the tube downwardly through the former and successively to present integral blanks in tubular form therebeneath for filling, sealing and package formation.

15. The improvements in a vertical form, fill and seal packaging machine as set forth in claim 14 wherein said manifold chamber communicates with three adjacent axial passageways as their associated rows of openings communicate with the tube external surface.

16. The improvements in a vertical form, fill and seal packaging machine as set forth in claim 14 wherein an axial vent passageway is provided in each of said distributors and is located so as to communicate with the axial passageways in the associated rolls as said axial passageways leave the manifold during rotation of the rolls.

17. The improvements in a vertical form, fill and seal packaging machine as set forth in claim 16 wherein an axial vent passageway is provided in each of said distributors and is located so as to communicate with the axial passageways in the associated rolls as said axial passageways approach the manifold during rotation of the rolls.

18. The improvements in a vertical form, fill and seal packaging machine as set forth in claim 14 wherein said rolls each having an associated drive shaft about which the associated distributor is loosely fitted so as to remain stationary, wherein said one end of each roll and the adjacent distributor surface are lapped, and wherein biasing means is provided for urging said roll and distributor surfaces together in substantially air tight engagement during relative rotation.

19. The improvements in a vertical form, fill and seal packaging machine as set forth in claim 14 wherein each of said rolls is provided with a sleeve of rubber-like material defining said rows of openings, and wherein said associated axial passageways extend beneath said sleeve and open radially outwardly respectively in communication with said rows of openings.

20. The improvements in a vertical form, fill and seal packaging machine as set forth in claim 14 wherein said openings are circular and between one-eighth and one-fourth inches in diameter, wherein between 20 and 30 rows of openings are provided, and wherein spacing between openings is less than one-half inch.

21. In a vertical form, fill and seal packaging machine having a source of flexible packaging material in the form of an elongated thin flat strip comprising successive package blanks as integral contiguous sections thereof, a tube former adapted to receive said strip material and progressively form the same to a depending and upwardly open tubular configuration, opposite longitudinal edge portions of the material being progressively juxtaposed by said former in parallel vertically extending relationship, product dispensing means associated with said former and operable for the gravity discharge of measured quantities of product to the tube interior spaced through its upwardly open end, side and end sealing means disposed beneath said former respectively to seal said longitudinal edge portions of the tube and to provide longitudinally spaced horizontal end seals across the tube, the improvement comprising at least two feed rolls disposed beneath the former and arranged on spaced horizontal axes in parallel relationship so as to peripherally engage opposite sides of the tube, each of the rolls having a plurality of small peripheral openings along at least that portion of its length engageable with the tube, vacuum generating means to cause the rolls to grip the tube at their peripheral surface, each of said feed rolls being hollow with an associated housing having a rectangular opening facing the tube and through which a portion of the roll projects to engage the tube, the housing including sealing means about the opening and in engagement with the roll, and the roll having an associated drive shaft which projects through the housing and which has sealing means associated therewith, and the housing interior being connected with said vacuum generating means whereby to create a reduced pressure within the housing and the roll for vacuum gripping and feeding of the tube by the roll, and means for turning the rolls in opposite directions and at equal peripheral speeds whereby to draw the tube downwardly through the former and successively to present integral blanks in tubular form therebeneath for filling, sealing and package formation.

22. The improvements in a vertical form, fill and seal packaging machine as set forth in claim 21 wherein said sealing means about said housing opening take the form of horizontal upper and lower linear seals engaging the peripheral surface of the roll and opposite vertically extending linear seals engaging opposite radial end surfaces of the roll.

23. The improvements in a vertical form, fill and seal packaging machine as set forth in claim 22 wherein said sealing means associated with the drive shaft comprises a pair of similar annular seals disposed about opposite end portions of the drive shaft and engaging the housing.

24. The improvements in a vertical form, fill and seal packaging machine as set forth in claim 22 and including a pair of annular seals arranged respectively to engage opposite radial end surfaces of the roll and an adjacent portion of the housing outwardly of the drive shaft.

* * * * *